US009320320B1

(12) United States Patent
Shamir

(10) Patent No.: US 9,320,320 B1
(45) Date of Patent: Apr. 26, 2016

(54) EXERCISE SHOE

(71) Applicant: Harry A. Shamir, Plymouth, MA (US)

(72) Inventor: Harry A. Shamir, Plymouth, MA (US)

( * ) Notice: Subject to any disclaimer, the term of this patent is extended or adjusted under 35 U.S.C. 154(b) by 317 days.

(21) Appl. No.: 14/152,757

(22) Filed: Jan. 10, 2014

(51) Int. Cl.
*A43B 13/18* (2006.01)

(52) U.S. Cl.
CPC ..... *A43B 13/189* (2013.01)

(58) Field of Classification Search
CPC .... A43B 13/189; A43B 13/20; A43B 13/203; A43B 13/206; A43B 17/026; A43B 17/03
USPC ..... 36/29, 35 B, 153, 154
See application file for complete search history.

(56) References Cited

U.S. PATENT DOCUMENTS 547,645 A 10/1895 Lacroix
1,069,001 A 7/1913 Guy
1,304,915 A 5/1919 Spinney
1,869,257 A 7/1932 Hitzler
2,086,389 A 7/1937 Pearson
2,488,382 A 11/1949 Davis
3,120,712 A 2/1964 Menken
3,469,576 A 9/1969 Smith at al.
3,765,422 A 10/1973 Smith
3,914,881 A * 10/1975 Striegel ..... A43B 17/026 36/153
4,008,530 A * 2/1977 Gager ..... A43B 13/203 36/28
4,100,686 A * 7/1978 Sgarlato ..... A43B 13/20 36/29
4,183,156 A 1/1980 Rudy
4,217,705 A 8/1980 Donzis
4,219,945 A 9/1980 Rudy
4,237,625 A 12/1980 Cole et al.
4,358,902 A 11/1982 Cole et al.
4,446,634 A 5/1984 Johnson et al.
4,458,430 A 7/1984 Peterson
4,567,677 A 2/1986 Zona
4,802,289 A 2/1989 Guldager
4,848,738 A 7/1989 Mueller
4,918,838 A 4/1990 Chang
4,936,030 A 6/1990 Rennex
4,951,938 A 8/1990 Smith, IV
4,991,317 A 2/1991 Lakic
4,999,932 A 3/1991 Grim
5,025,575 A 6/1991 Lakic
5,097,607 A 3/1992 Fredericksen
5,167,082 A 12/1992 Chen
5,195,257 A 3/1993 Holcomb et al.
5,199,191 A 4/1993 Moumdjian
5,375,346 A 12/1994 Cole et al.
5,406,719 A 4/1995 Potter
5,564,202 A 10/1996 Hoppenstein
5,624,356 A 4/1997 Roberts
5,669,161 A 9/1997 Huang
5,673,498 A * 10/1997 Amir ..... A43B 13/206 36/28
5,678,328 A 10/1997 Schmidt et al.
5,701,687 A 12/1997 Schmidt et al.
5,706,589 A 1/1998 Marc
5,741,568 A 4/1998 Rudy
5,771,606 A 6/1998 Litchfield et al.
5,794,361 A 8/1998 Sadler (Continued)

*Primary Examiner* — Ted Kavanaugh
(74) *Attorney, Agent, or Firm* — John P. McGonagle

(57) ABSTRACT

A shoe constructed to provide exercise to a wearer while walking or jogging is provided. The shoe provides two bladders partially filled with liquid in the shoe's insole. The bladders are positioned rearward and forward and are interconnected by means of a hollow, flow resisting conduit. Heat venting is provided through fabric panels in the shoe upper, perforations in the shoe insole, metallic fibers in the shoe outsole, and vent tubes in the shoe inner sole.

5 Claims, 6 Drawing Sheets

(56) References Cited

U.S. PATENT DOCUMENTS 5,815,954 A 10/1998 Huang
5,830,553 A 11/1998 Huang
5,875,571 A 3/1999 Huang
6,041,522 A 3/2000 Anteby
6,131,315 A 10/2000 Frye et al.
6,138,382 A * 10/2000 Schoesler ..... A43B 7/147 36/153
6,178,663 B1 1/2001 Schoesler
6,341,432 B1 1/2002 Muller
6,397,498 B1 6/2002 Yoo
6,428,865 B1 8/2002 Huang
6,553,690 B2 * 4/2003 Di Girolamo ..... A43B 7/06 36/3 B
6,557,272 B2 5/2003 Pavone
6,584,706 B1 7/2003 Ellis, III
6,722,059 B2 4/2004 Robinson, Jr. et al.
6,745,499 B2 6/2004 Christensen et al.
6,845,573 B2 1/2005 Litchfield et al.
6,892,477 B2 5/2005 Potter et al.
6,966,129 B2 11/2005 Meschan
7,007,412 B2 3/2006 Munster
7,013,585 B2 3/2006 Lo
7,020,990 B2 4/2006 Khoury
7,036,245 B2 5/2006 Russell
7,043,857 B2 5/2006 Meschan
7,076,892 B2 7/2006 Meschan
7,140,126 B2 11/2006 Crane et al.
7,152,343 B2 12/2006 Whatley
7,168,186 B2 1/2007 Russell
7,171,765 B2 2/2007 Lo
7,174,658 B2 2/2007 Ellis, III
7,181,867 B2 2/2007 Litchfield et al.
7,204,041 B1 4/2007 Bailey, Sr. et al.
7,210,249 B2 5/2007 Passke et al.
7,219,449 B1 5/2007 Hoffberg et al.
7,225,491 B2 6/2007 Reed et al.
7,254,906 B2 8/2007 Morris et al.
7,334,356 B2 2/2008 Ellis, III
7,380,351 B1 6/2008 Pavone et al.
7,395,617 B2 7/2008 Christensen et al.
7,475,498 B2 1/2009 Litchfield et al.
7,533,475 B2 5/2009 Garneau
7,533,477 B2 5/2009 Goodwin et al.
7,546,699 B2 6/2009 Ellis, III
7,578,077 B2 8/2009 Marc
7,600,331 B2 10/2009 Litchfield et al.
7,603,794 B2 10/2009 Oh
8,281,504 B2 * 10/2012 Morita ..... A43B 17/026 36/153
2003/0019128 A1 1/2003 Litchfield et al.
2003/0101619 A1 * 6/2003 Litchfield ..... A43B 13/203 36/29
2004/0098882 A1 5/2004 Tuan
2004/0250448 A1 12/2004 Reed et al.
2005/0055846 A1 3/2005 Caldwell
2005/0132617 A1 6/2005 Potter et al.
2005/0178025 A1 8/2005 Litchfield et al.
2005/0241185 A1 * 11/2005 Flood ..... A43B 7/1415 36/29
2006/0248750 A1 11/2006 Rosenberg
2007/0006488 A1 1/2007 Litchfield et al.
2007/0101611 A1 5/2007 Li
2007/0294916 A1 12/2007 Park
2008/0005929 A1 1/2008 Hardy et al.
2008/0028638 A1 * 2/2008 Morita ..... A43B 7/142 36/44
2008/0127510 A1 6/2008 Yang
2008/0216349 A1 9/2008 Wu
2009/0019726 A1 1/2009 Gornatti
2009/0064536 A1 3/2009 Klassen et al.
2009/0083995 A1 4/2009 Hsieh et al.
2009/0151203 A1 6/2009 Boyer et al.
2009/0165333 A1 7/2009 Litchfield et al.
2009/0178302 A1 7/2009 Kim
2009/0199430 A1 8/2009 Montross

* cited by examiner

EXERCISE SHOE

CROSS-REFERENCE TO RELATED APPLICATIONS

This application id a continuation-in-part of U.S. patent application Ser. No. 12/798,830, filed: Apr. 13, 2010.

BACKGROUND OF THE INVENTION

This invention relates to shoes, and in particular, to footwear generating an enhanced expenditure of energy invested with each walking step with minimal recovery of the invested energy.

Historically, maximal return of invested energy has been the mantra of athletics, ever since the first "sneaker" or rubber soled sport shoe, and before that the invention of the heel in Julius Caesar's day, designed to reduce his troops' fatigue from walking. However, in our times the struggle against obesity, the desire for trimness, and the need for fitness achieved at low financial and time costs, mandate a new approach to shoe function. Prior art efforts for exercise shoes have included weights and sole forms. However, these have had limited appeal, due, not only to their bulk and discomfort, but also as not being well attuned to an exercise goal. The approach of using weights attached to ankles or using weighted shoes does assist in the expenditure of energy, but only of muscle masses involved in lifting the weight vertically, and overcoming the inertia of the weight masses in horizontal motion. Moreover, the lifting of such weights is uncomfortable and possibly injurious to the joints and body structure ligaments. The sole forms approach, using shaped soles, actually does exercise the foot, though mostly in flexure, which in reality is a stretch exercise, not primarily a muscle contraction exercise system, hence not intrinsically an energy dissipating exercise and strength and stamina enhancement system. Examples include the "earth shoe" that uses no heel and thickens the anterior part of the sole (lowering the foot posterior relative to the anterior), and curved soles that force the foot into a rocking motion during a step.

This Invention has three objectives, each attained by separate means:

1. Creation of shoes whose soles induce the wearer to expend energy in exercise by enhanced investment of effort while performing plain walking or jogging.
2. Dissipation of heat generated by exercise.
3. Design of insole to enhance comfort during the walk or jog.
4. Optional provision of arch supports to minimize arch discomfort or pain during the enhanced investment of effort.

These objectives address the gamut of people wishing to increase their exercise efforts during walking and jogging. This includes sports and military and martial arts trainees, devotees of fitness, those wishing to reduce excess fat-based weight, and others. The optional provision of the invention also addresses the needs of people wishing to increase their exercise efforts during walking and jogging whose arch is non-optimal.

SUMMARY OF THE INVENTION

The present invention's novel approach is to increase a shoe's energy absorption, dissipate as much of it as possible, and diminish as much as possible the energy return to the shoe wearer during the walking or jogging effort. The principle of the present invention is to create machines having the function, form, and fit of shoes, that instead of having the aim to maximally reduce the effort of walking and jogging as accepted throughout the history of shoes to this day, actually induce the wearer to enhanced investment of effort, to expend more (vs. traditional athletic shoes) energy in exercise while performing plain walking or jogging. In other words, the concept is the creation of footwear generating enhanced expenditure of energy with each walking or jogging step, greater than heretofore traditional expenditure of the energy irrecoverably expended in deforming the shoes during the walking or jogging. Deliberate and planned energy hysteresis is made to exist between successive periods of compression of the sole elements under effect of wearer weight and inertia.

Energy expenditure is performed mainly upon the weight of the body and additional human sourced forces imparting or maintaining velocity to the body (overcoming inertia forces) result in sequentially compressing the sole anterior and posterior, with each sole part expanding maximally upon the other sole part being compressed. The sole is comprised of three layers, the insole, the inner sole and the outsole. The insole comprises the top layer; the outsole the bottom layer; and the inner sole is sandwiched between the insole and the outsole.

The present invention is for an athletic shoe whose essence is an exercise source by means of the absorbance of human energy from mechanisms within the shoe sole with subsequent dissipation of the energy to the environment in the form of heat. The athletic shoe of this invention is similar in appearance and partially in structure to Johnson (U.S. Pat. No. 4,446,634), but not in fit and function. The similarity in structure is limited to the incorporation in the soles of bladders of fluid and a connecting path between them. The dissimilarity is that in Johnson the fluid fills all the bladders completely since the meaning of "fluid" in Johnson is restricted to compressible gas. Whereas, in the present invention the fluid is solely an essentially incompressible liquid made to flow from anterior bellows chamber to posterior bellows chamber and vice versa, via hydraulic head reducing passageways. The function of Johnson and all other prior art athletic shoes to date, other than the ones based on Instability, is to minimize wearer fatigue and return to the wearer as large a portion as possible of the human energy expended in the gait, whether in walking or jogging. In contrast, the function of the present invention is to provide the wearer some exercise additional to the exercise inherent in the walking or jogging performed barefoot, semi-barefoot, or using conventional running shoes. The function of the present invention is thus to increase, not reduce, wearer's long term energy expenditure in exercise, therefore deliberately increasing fatigue, and return to the wearer a very low portion of the energy expended in the gait, whether walking or jogging, yet not to the point of discomfort in the use of the shoe.

Prior art athletic shoes designed to ostensibly exercise the wearer's muscles include making the wearer unstable. Prior art instability has been attempted by adding semisolid bumps to the sole thus creating a rocking action to the foot and counteracting the rocking action by active leg muscle contractions. Alternatively, Johnson-style, air-filled bumps have been added to the shoe sole to attain the same instability objectives. In theory this goal is achieved due to the constant attempt by the inner ear balancing mechanism to counteract instability provided by the shape of the shoe soles. In reality, this is a transient effect, quickly subsiding by the body adjusting to the inherent instability. Within a period of some hours wearing such shoes, the body finds a stable posture in both standing and walking without much compensating muscle contractions. This habituation is similar to the process of learning to ride a bicycle, learning to skate, or skiing. The process of learning is too brief to succeed in its stated goal.

Various levels of the additional exercise are generated by two methods, both having in common the transformation of liquid flow into heat, which is then dissipated to the atmosphere. Structurally, the inner sole of the shoe contains two bellows chambers, the posterior residing within the heel of the shoe sole, and the anterior under the ball of the foot. The front and rear chambers are approximately of equal volume. These two bellows are chambers filled by a liquid to approximately half their natural expanded volume. The rest of the natural expanded volume is reduced to nil by extracting as much as possible of the remaining air from the bellows chambers. These two bellows chambers are connected by one or more interchamber passageways which provide the function of resistance to flow. These passageways may or may not contain flow resistance valves. Where no valves exist, then the passageways themselves are constructed such as to create a measure of resistance to liquid flow. When deemed necessary for a particular shoe model to provide adjustment to the flow restriction between the chambers, externally accessible between-chambers flow adjusting valve or valves may be incorporated with the interchambers passageway or passageways.

The first method to increase the exercise level is to create various levels of resistance to the liquid flow (also called "hydraulic head-loss") within the interchambers flow passageways by way of strictures, configurations or any other method that increases resistance to liquid flow within the passageways, such as internal surface roughness or any other method that increases turbulence of liquid flow within the passageways. The second method to modify the exercise level is by selecting the nature of the liquid being moved about from chamber to chamber during the gait.

The sum total of the additional exercise can be from a few percentage points of the total human energy expenditure dissipated by the gait when using an average athletic or running shoe, to up to twice that energy amount. However, the normal additional expenditure of the present invention is in the range of 15% to 50%. Hence the function of the present invention is different from the prior art, such as the Johnson patent.

With respect to fit, Johnson and the other prior art are designed to improve the results of the athletic prowess exhibited by the wearer at the time of performance of the athletic action, whatever the current level of wearer's personal physical fitness might be. In contrast, the fit of the present invention is to improve the fitness of the wearer, in preparation of any eventual performance of athletic action, or alternatively for general health and fitness objectives such as weight reduction or improved stamina. Hence the fit of the present invention is not in the performance of athletics, rather in its practice (i.e. getting ready for the task) or workout, which of course occur at different times.

An additional feature of the present invention is the presence of a duct between one of the bellows chambers and the outside ambient air, or alternatively between one of the interchamber passageways and the outside ambient air, said duct containing a valve enabling liquid to be inflowed into the chamber or passageway, and allowing air to be extracted from the chambers, by a manufacturing process liquid filling apparatus. The valve enables liquid from the filling apparatus to flow into the chambers, without exiting nor leaking out when the shoe is in use or between uses. This valve may be temporary, as part of the manufacturing process, removed or otherwise made to disappear by the end of the manufacturing process, or may be a permanent feature of the specific model. As normal and known in the art of valving systems, a bypass provision for allowing liquid to be drained out from the chambers may also be built into such a valve system, for activation upon special need.

The pumping action upon the liquid during gait is as follows: upon the weight or impact of the wearer bearing upon the heel, the liquid is squeezed into the anterior chamber and filling it, then upon the weight and force from the ball of the foot of the wearer bearing upon the anterior of the shoe, the liquid is squeezed into the posterior chamber and filling that. The nature of the above described liquid transfer process depends on proper gait which includes rolling of the foot from heel to toes during walk or jog. The liquid transfer process will not occur if the wearer sprints or runs with solely the ball of the foot making contact with the ground, that is with the heel never contacting the ground. This is actually a safety feature, since upon the wearer needing to perform an emergency sprint using solely the balls of the feet, the present invention shoe will function as any other athletic shoe and will not subtract from the effectiveness of the sprint. The nature of the above described liquid transfer process also enhances the efficacy of exercising by walking backwards, a known method for improving muscle tonality from the waist down, especially when done uphill or downhill.

In the present invention a variety of liquids may be used. For example, simple water (considered the base-line liquid), alcohol or other solutions, a multiplicity of liquid crystal types at various dilutions in a variety of dilutants (thus exploiting the mechanical properties of liquid crystals), silicone oils and solutions based on silicones, and any other suitable liquids as will suit the sundry purposes of various energy demanding shoe models. For instance, use of the silicone based materials enables the wearer to engage in running while minimizing the additional exercise feature of the present invention shoe, by exploiting the changes in the Force-Deformation curve that occur on changing the liquid's strain rate (an example of which is the well known Silly-Putty). When running, the strain rate of the selected silicone liquid will be sufficiently rapid to momentarily transform the liquid into a semi-solid elastomer, in essence eliminating interchamber flow. For the purpose of reducing the energy dissipation provided by a particular shoe model stemming from this Invention, the use of a water solution of Methyl or Ethyl alcohol, actually reduces the resistance to flow within the passageways, and therefore reduces the additional exercise rate provided by the present invention shoe sole. In summary, with the present invention, the same shoe or shoe sole construction geometry can be used resulting in a multiplicity of additional exercise rates (hence a variety of models), merely by changing the nature of the liquid in the bellows chambers.

The comfort of wearing most athletic shoes including the present invention shoe, stems mainly from the elastomeric characteristics of the sole construction, with its multiplicity of elastomers exhibiting a variety of Force-Deflection curves and Hysteresis. Indeed it is the knowledge of the interplay of the various materials exhibiting these characteristics, that constitute one of the main elements of professionalism of athletic shoe designers. In the case of the present invention, the hysteresis is enhanced, not minimized as would be normal in the industry. The essence of the exercise source of the present invention shoe is the increase of sole hysteresis.

The construction of the shoe uppers must contain provisions for easy transpiration, as well as dissipation of the additional heat generated by the additional exercise of the wearer's foot. Such provisions are usually panels within the uppers, that enable easy transpiration, i.e., the transfer of air between the inside of the shoe and the outside air, for ventilation and dissipation of heat and perspiration. Heat transfer between the sole and the outside environment can be enhanced by adequate surface area contact between sole and air, including by judicious use of outer sole creases that increase the sole's surface area in contact with the outside environment, reduction of sole element thicknesses, use of inner sole material elements that enhance heat transfer, and use of holes within the inner sole that are trasverse to the shoe longitudinal axis. This design results in heated air being pumped out of the holes when the wearer trods down, and outside cooling air being aspirated back upon the holes elastically recovering their shape when the downward trod action is relieved. For example of techniques less well known to increase the heat transfer rates is the use of metallic inclusions or fillers within outer sole parts, the fillers being preferentially in the form of a multiplicity of short thin metallic fibers enhancing the conductance of heat from one part of the shoe to another. By short is meant fibers approximately 1 to 5 mm long and approximately 0.5 mm in diameters. Such embedding of metallic fiber fillers in solid elastomers is known in the art of electronic assemblies for performing the functions of dissipative pathways to static electricity, and in electromagnetic shielding, some versions being commercially available. For purposes of keeping the shoe at low weight, foamed and microfoamed elastomers are preferable over solid elastomers. The innovation taught here is the incorporation of heat conductive fibers in the foams or microfoams. Another construction option is by use of commercially available glass or plastic microbubbles or microballoons, gas filled usually at pressures near vacuum, well known in the plastics industry as lightweight fillers. For the purposes of using them for enhanced heat transfer, commercially available microbubbles exist that are plated or coated with a metallic outer layer.

Though the use of the present invention exercise shoes is to induce work and some fatigue during walking, such work need not be uncomfortable. To enhance the comfort of walking, the present invention also includes the optional element of foam insole by a design that provides for cushioning of the interface between the foot and the shoe sole in contact with the foot. The insole consists of a soft foam body having elasticity such that in the time duration within the gait, when its compression by the weight of the wearer and the force exerted for the gait are removed from section of the insole, that section returns to its original shape. This elasticity is achieved by a combination of basic elastomeric material, the size of the foam cells, the quantity of embedded microbubbles or microballoons, the bumps projecting from one surface of the insole, the cavities embedded in the opposite surface, and the perforations in the insole that also serve as heat and perspiration dissipation paths. The bumps and cavities are preferably about 1.5 mm radius, but may range between 1 and 5 mm radius, and the perforations may range from 1 to 3 mm in diameter. The material of such elastomeric foam insoles normally creates surface friction against socks thereby hindering the insertion of the foot into the shoe. To overcome this hindrance, a thin low friction skin is provided, preferentially bonded to the top surface of the Insole, where the thickness of this skin can approximately range from 0.2 mm to 1.2 mm, and preferentially be designed for transpiration.

A large number of people suffer from either flat feet or weak arches. Most available arch supports attempt to force the foot to assume the apparent shape the foot portrays, these external contours being deemed "normal" or "correct". However, it has been realized that this external contour is shaped by the form and meshing of the bones in the arch region in combination with the soft tissue. On investigating the skeleton of a foot deemed "normal" or "correct", it becomes obvious that the bones that comprise the part of the foot arch in line with the big toe actually are somewhat closer to the floor (lower) than the bones in line with the toe adjacent to the big toe. Indeed the latter bones create a cavity in that area. Therefore it has been found that the better arch support is gained by lowering the external arc support structure in the area in line with the big toe, to correspond with the skeletal architecture, not the skin geometry. Some commercial arch supports are available that follow that insight. This Invention seeks to add comfort to the wearer by optionally adding this feature as a contoured structure, under the foam Insole, at the customer's request.

These together with other objects of the invention, along with various features of novelty, which characterize the invention, are pointed out with particularity in this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
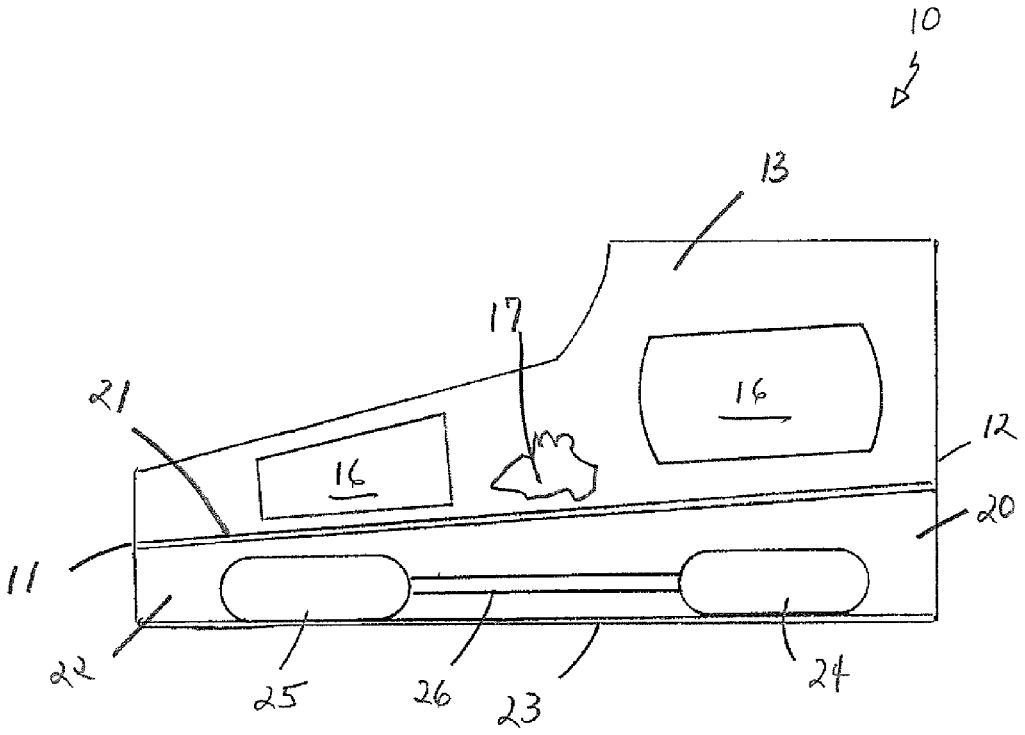
FIG. 1 is a diagrammic side view of the invention.
Figure 2:
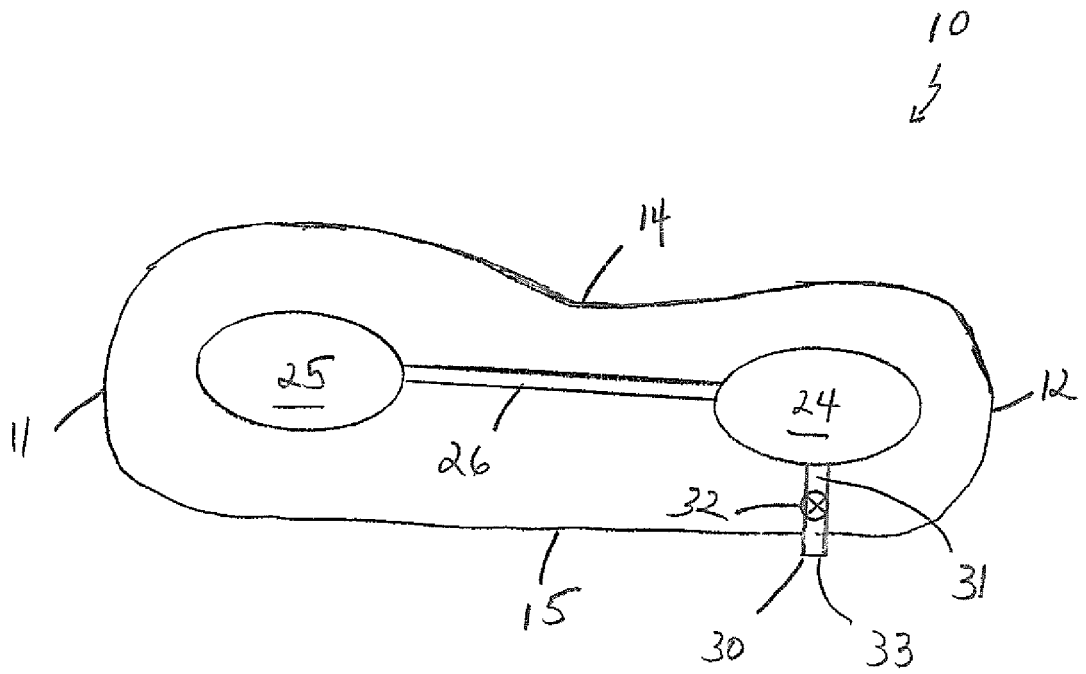
FIG. 2 is diagrammic bottom view of the invention.

Referring to the drawings in detail wherein like elements are indicated by like numerals, reference numeral 10 refers to an exercise shoe constructed according to the principles of the invention. The exercise shoe 10 is comprised of a front portion 11, a rear portion 12, an upper portion 13, an instep side portion 14, an opposite outside portion 15, and a sole portion 20 joined to said upper portion 13, said front and rear portions defining an exercise shoe longitudinal axis. The exercise shoe front, rear, upper, instep side, outside and sole define an exercise shoe interior 17 for placement of the foot of a shoe wearer.

The sole portion 20 is comprised of three layers: an insole 21, an inner sole 22, and an outsole 23. The insole 21 comprises the top layer; the outsole 23 the bottom layer; and the inner sole 22 is sandwiched between the insole and the outsole. The inner sole 22 is preferably made of a dense elastomer foam such as a dense polyurethane foam. The inner sole foam may have microballoons added. The microballoons will make the foam denser, but lighter. The insole 21 is made from a less dense elastomer foam with larger foam cells thereby providing a softer material. The outsole 23 is made from a relatively tough, long wearing, resilient material such as rubber or other elastomeric material, and generally provides a tread surface for the shoe.

Figure 3:
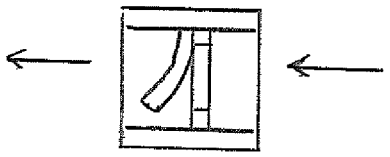
FIG. 3 is a side sectional view of a flap valve.
Figure 4A:
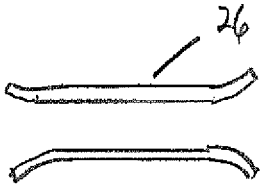
FIG. 4A is a side sectional view of the flow resisting conduit.
Figure 4B:
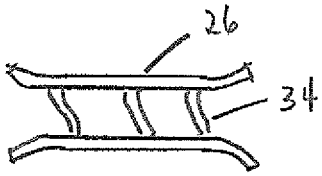
FIG. 4B is a side sectional view of the flow resisting conduit with single thread inserts.
Figure 4C:
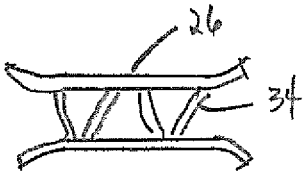
FIG. 4C is a side sectional view of the flow resisting conduit with double thread inserts.
Figure 4D:
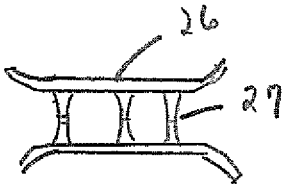
FIG. 4D is a side sectional view of the flow resisting conduit with interferer inserts.
Figure 4E:
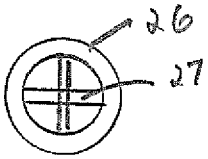
FIG. 4E is a longitudinal section view of the flow resisting conduit with interferer insert.

The sole portion 20 is further comprised of two bladders comprised of a rear bladder 24 and a forward bladder 25, said bladders interconnected by a hollow, flow resisting conduit 26. Each bladder 25, 26 is positioned within the inner sole 22 adjacent to the outsole 23. The bladders are of approximate equal size. The bladders are filled with a liquid to approximately half their natural expanded volume and any remaining air is withdrawn. The nominal liquid is preferably water. To increase energy dissipation, liquid crystals may be added to the water. To reduce energy dissipation, alcohol may be added to the water. A filling valve 30 is provided to initially bring liquid into the bladders from an outside source. The filling valve 30 may also be used to replenish the liquid within the bladders. In the embodiment shown, the filling valve 30 is comprised of a hollow filling conduit 31 interconnecting the rear bladder 24 with an area outside of the shoe. The filling conduit 31 has a one-way valve 32 inserted into the filling conduit interior 33. In the embodiment shown, the one-way valve is a flap valve. See FIG. 3.

The conduit 26 is designed to impede liquid flow between the bladders. To accomplish this the conduit may have a narrow diameter impeding flow between the bladders. In another embodiment flow interferers 27 may be inserted into the conduit. Alternatively, a plurality of threads may be inserted into the conduit. See FIGS. 4A-4E.

Figure 5:
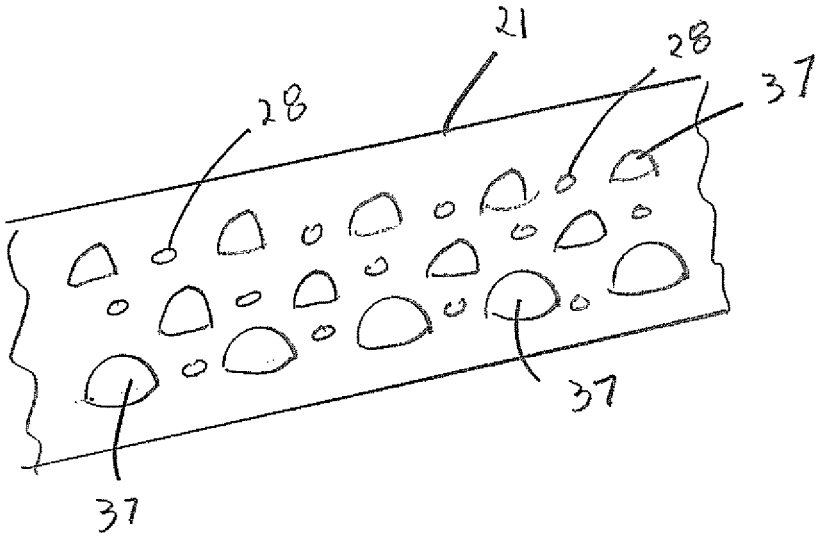
FIG. 5 is a partial section view of a modified insole.
Figure 7:
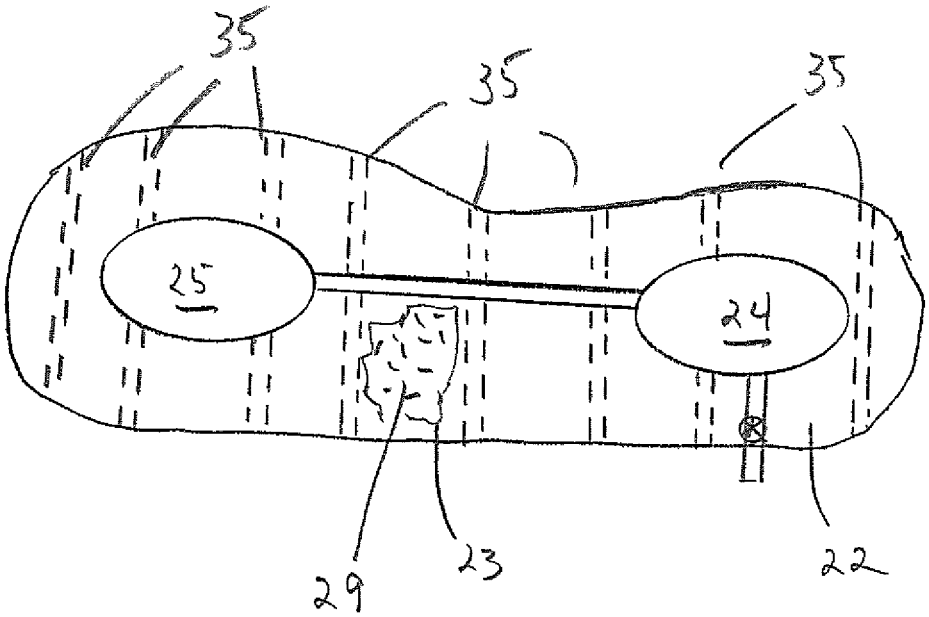
FIG. 7 is a diagrammic bottom view of another embodiment of the invention.

Heat dissipation is an important feature of the present invention. The exercise shoe upper portion 13 has porous fabric panels 16 for releasing heat from the shoe interior to the outside. The sole portion insole 21 has a plurality of perforations 28 for releasing heat from the sole portion 20, through the shoe interior 17 and out through the fabric panels 16. See FIGS. 1 and 5. The exercise shoe provides an additional path for heat dissipation. A plurality of short, thin metallic fibers 29 may be imbedded into the outsole 23. The metallic fibers enhance the flow of heat from within the sole portion 20 out through the outsole 23 to the ground. See FIG. 7.

Figure 6:
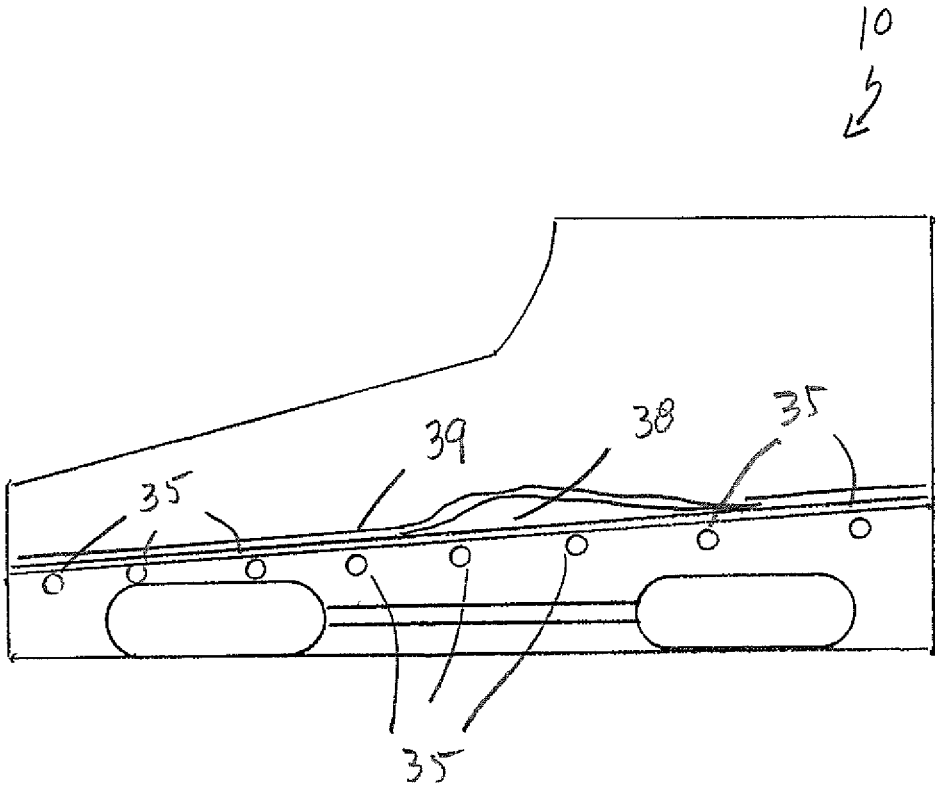
FIG. 6 is a diagrammic side view of another embodiment of the invention.

Another path for heat dissipation is through the use of a plurality of hollow vent tubes 35 placed within the inner sole 22. Each vent tube 35 has a longitudinal axis transverse to the exercise shoe longitudinal axis. Each vent tube 35 will have at least one end opening out through either or both the instep side portion 14 and/or outside portion 15. See FIGS. 6 and 7.

Although the exercise shoe is designed for exercise, certain comfort features may be added. The insole 21 may have a plurality of small bumps 37 interspersed between the insole perforations, said bumps preferably made from a soft and flexible elastomeric foam. See FIG. 5. Arch supports 28 of various forms may be added between the insole 21 and inner sole 22. For ease of placing the exercise shoe onto the foot of a wearer, a low-friction insole skin 39 may be added on top of the insole 21. See FIG. 6.

It is understood that the above-described embodiments are merely illustrative of the application. Other embodiments may be readily devised by those skilled in the art which will embody the principles of the invention and fall within the spirit and scope thereof.

I claim:

1. An exercise shoe, comprising:

a front portion, a rear portion, an upper portion, an instep side portion, an opposite outside portion, and a sole portion joined to said upper portion, said front and rear portions defining an exercise shoe longitudinal axis, said exercise shoe front, rear, upper, instep side, outside and sole defining an exercise shoe interior for placement of a shoe wearer foot;

said sole portion comprised of three layers: an insole, an inner sole, and an outsole, wherein said insole comprises a top layer, said outsole comprises a bottom layer and said inner sole sandwiched between the insole and the outsole;

said sole portion further comprised of two bladders comprised of a rear bladder and a forward bladder, said bladders interconnected by a hollow, flow resisting conduit, each said bladder positioned within the inner sole adjacent to the outsole, said bladders of approximate equal size, wherein said bladders are filled with a liquid to approximately half their natural expanded volume;

a plurality of porous fabric panels in the upper portion;

a plurality of perforations in the insole;

a plurality of short, thin metallic fibers imbedded into the outsole;

a plurality of hollow vent tubes placed within the inner sole, each vent tube having a longitudinal axis transverse to the exercise shoe longitudinal axis, wherein each vent tube has at least one end opening out through a side portion.

2. An exercise shoe as recited in claim 1, further comprising:

A plurality of small bumps on the insole interspersed between the insole perforations, said bumps made from a soft and flexible elastomeric foam;

an arch support between the insole and inner sole; and a low-friction insole skin on top of the insole.

3. An exercise shoe as recited in claim 2, wherein:

said inner sole is made of a dense elastomer foam;

said insole is made from an elastomer foam, less dense than the foam of the inner sole; and said outsole is made from a tough, long wearing, resilient material.

4. An exercise shoe as recited in claim 3, further comprising:

a filling valve comprised of a hollow filling conduit interconnecting the rear bladder with an area outside of the exercise shoe, said filling conduit having a one-way valve inserted into a filling conduit interior.

5. An exercise shoe as recited in claim 4, further comprising:

a plurality of microballoons in said inner sole foam.

* * * * *